US010390663B2

(12) United States Patent
Marburger et al.

(10) Patent No.: US 10,390,663 B2
(45) Date of Patent: Aug. 27, 2019

(54) TOWEL PROTECTOR

(71) Applicants: Heather Shimek Marburger, Edna, TX (US); Mark Shimek, Port Lavaca, TX (US)

(72) Inventors: Heather Shimek Marburger, Edna, TX (US); Mark Shimek, Port Lavaca, TX (US)

( * ) Notice: Subject to any disclaimer, the term of this patent is extended or adjusted under 35 U.S.C. 154(b) by 0 days.

(21) Appl. No.: 16/040,925

(22) Filed: Jul. 20, 2018

(65) Prior Publication Data

US 2019/0174971 A1 Jun. 13, 2019

Related U.S. Application Data

(63) Continuation of application No. 14/663,826, filed on Mar. 20, 2015, now abandoned.

(60) Provisional application No. 61/969,115, filed on Mar. 22, 2014.

(51) Int. Cl.
*A47K 10/22* (2006.01)
*A47K 10/32* (2006.01)

(52) U.S. Cl.
CPC ..... *A47K 10/22* (2013.01); *A47K 10/32* (2013.01); *A47K 2010/3233* (2013.01)

(58) Field of Classification Search
CPC ..... A47K 10/22; A47K 10/32; A47K 10/38; A47K 10/3836; A47K 2010/3233
See application file for complete search history.

(56) References Cited

U.S. PATENT DOCUMENTS 686,324 A * 11/1901 McKay ..... B65H 35/0026 206/39
4,487,376 A * 12/1984 Compton ..... A47K 10/3836 225/79
4,690,345 A * 9/1987 Cotey ..... B65H 75/185 206/416
4,720,053 A * 1/1988 Vance ..... A47K 10/3836 225/79
4,738,385 A * 4/1988 Bell ..... A47K 10/40 225/106
4,792,102 A * 12/1988 Olson ..... A47K 10/38 242/423.2
4,860,893 A 8/1989 Kaufman
(Continued)

FOREIGN PATENT DOCUMENTS

EP 1232715 8/2002
WO 2006050748 5/2006

*Primary Examiner* — William A. Rivera
(74) *Attorney, Agent, or Firm* — M. Susan Spiering; Ferrells PLLC

(57) ABSTRACT

Disclosed is a method and cover for maintaining hygiene of a roll of paper towels which are in a community or open area. A cover for protection of a paper towel roll secured about a vertical axis is provided. The cover is preferably circular to match the diameter of the roll. The cover has a cleanable top layer, a hole at the center of the cover and an optional bottom layer having a backing material. The cover is placed on the top of the roll which keeps the roll dirt or germ-free when held by the user. The backing material present on the lower side of the cover adheres sufficiently to the paper towel roll to not slide off the roll when not in use. During use, the cover is held down by the user with one hand, while grabbing and removing a sheet from the roll with the user's other hand.

15 Claims, 7 Drawing Sheets

(56) References Cited

U.S. PATENT DOCUMENTS

| | | | | |
|---|---|---|---|---|
| 5,788,136 | A * | 8/1998 | Othman | A47K 10/38 225/79 |
| 5,938,141 | A * | 8/1999 | Kanbar | B65H 23/06 206/416 |
| 6,966,320 | B1 * | 11/2005 | Baynes | A61B 46/00 128/849 |
| 7,124,976 | B1 * | 10/2006 | DeVincenzo | A47K 10/3836 242/423.1 |
| 7,328,869 | B1 * | 2/2008 | Zies | A47K 10/3836 242/597.7 |
| 7,533,846 | B2 | 5/2009 | Sellars | |
| 8,602,345 | B2 | 12/2013 | Tuttle | |
| 8,616,408 | B2 | 12/2013 | Saarvali | |
| 2012/0255928 | A1 | 10/2012 | Greenberg | |

* cited by examiner

TOWEL PROTECTOR

CROSS REFERENCE TO RELATED APPLICATION(S)

This US non-provisional patent application is based on U.S. Provisional Patent Application Ser. No. 61/969,115, entitled "Towel Protector", filed Mar. 22, 2014, and copending U.S. Non-Provisional patent application Ser. No. 14/663,826, of the same title filed on Mar. 20, 2015, the priority of all which is hereby claimed and the disclosure of which is incorporated herein by reference in its entirety.

BACKGROUND

Field of the Invention

The present invention relates generally to a device for ensuring sanitary measures while using a paper towel. More particularly, the present invention relates to a protective cover for a paper towel roll while dispensing sheets of the paper towel.

Description of the Related Art

Use of disposable clean products made of paper, such as paper towels, toilet papers, facial tissues and various similar products is common, and often these items are packaged on rolls, having perforated sheets for a user to tear off the roll during use. A toilet roll holder, also known as a toilet paper dispenser, is a device that holds and dispenses a roll of toilet paper. Various methods and devices for dispensing paper towel sheets are well known. These include paper towels coiled around a horizontal or a vertical towel rod which are fixed, mounted on walls and in some cases embedded within the wall. Many of them have protection for the paper towel roll in the form of a plastic or a metal casing which protects the roll from getting wet, soiled, crushed or disfigured. These casing are often used also as dispensing means so as a user gets a limited number of sheets of towels, or the towels obtained are not touched by others. Often these casings are seen as packing or packaging items around the roll of paper before a user begins to use the paper.

The casings used as packaging do not generally help in maintaining the hygienic conditions of the paper towel roll during use, since the packaging is removed to allow tearing of the towels from the roll. Often during use, the structural integrity of the towel roll is disrupted by the user. When the user dispenses the paper towel from the roll, he is either required to use both hands to tear the sheet of paper or is required to grab the roll to pull off a sheet of paper. When using both hands, one hand, or the fingers of a hand, is normally placed along the top or side edge of the roll of paper to secure it, while the other hand grabs a sheet and tears it off. Normally the user's hands or fingers are dirty or wet which in turn spoils the roll when the user touches it. If a roll of paper is in a community area for many to use, germs from many can easily spread from the use of the same roll of towels. If someone touches the roll with greasy or dirty hands so as to clean them therewith, the result is often the edge of the towel roll is now dirty or greasy with whatever was on the users' hand.

Some common solutions to these problems of use of paper towels include metal or plastic dispensers enclosing the roll of paper towels so that a user grabs a specific towel by the towel edge without touching the entire roll. It is now current practice that many of these dispensers contain sensors so that a set number of towels are dispensed with each use. The dispensers do not help in maintaining the hygienic feature of the paper towel when the towel is used without the dispenser.

Another solution is to contain a roll of towels within a can, box, or dispensing member, wherein the towels are pulled through top of the member. The top often has some form of flexible slitted, serrated, notched, or tooth-like opening so as the towels are pulled and wrung of any type of liquid cleaner they may contain. Often however, one uses the towel roll directly out of the plastic casing or packaging and the towel roll is in an open community area. Hence propagating any germ transfer among users of the roll.

There exist in the art containers for pop-up wipes where the top of the container has a slit opening for dispensing wipes. This type of system requires special sizes of wipes or towels and is not designed for dispensing towels from a roll of towels as considered herein.

The following are background references for this invention: 1) Publication US 2012/0255928 is directed to straw holder integrated with a beverage container, 2) EP 1232715B1 is directed to carousel dispensing system for paper towels, 3) U.S. Pat. No. 8,616,408 is directed to a paper towel dispenser which includes a housing for holding a stack of interfolded towels. 4) WO 2006-050748A1 is directed to transport- and storage package containing paper-rolls, 5) Publication U.S. Pat. No. 7,533,846 is directed to towel roll product with supportive, protective wrapper, 6) U.S. Pat. No. 4,860,893 is directed to paper roll cover and process for manufacture, and 7) U.S. Pat. No. 8,602,345 is directed towards a sanitary roll paper towel holder. None of these references cite a solution to the problem as discussed and claimed by Applicant in the subject application.

Accordingly, there exists a need for a simple solution for keeping the paper towel rolls clean and hygienic when used without an enclosed dispenser. There is a need for a protecting device or material that helps the user dispense towel sheets without compromising the sanitary or hygienic conditions of the remaining paper towel roll. Few methods have been employed in the past to maintain sanitation of an exposed roll of paper towels, and includes providing hand sanitizers along with the towel roll, which further increase the cost and only indirectly addresses the hygiene issue of a community towel roll.

SUMMARY

Disclosed is a method to maintain the hygienic features of an exposed roll of paper towels used by a community. Also disclosed is a protective covering for use with a vertically standing roll of towels. The towels may be on a roll for dispensing, or used without a roll, wherein the protective covering sits on top of the roll without an internal rod to secure itself. While the invention is described relative to use with a roll of paper towels, it may be used with a roll of toilet paper, or other types of paper found on a roll having (preferably perforated) sheets for tearing.

An object of the present invention is to provide a protective covering for the top of a paper towel roll that is capable of maintaining sanitary conditions of the towels without damaging the paper towels of the roll. As used herein, paper means traditional standard paper or paper-like or cloth-like towels which are secured on or in a roll or in a roll like fashion for dispensing.

An embodiment of the invention provides a protective circular cover configured to be placed over a vertically standing paper towel roll. The circular cover includes a hole at the center, a top layer, and an optional bottom layer having a backing material. The hole is configured to accommodate the towel rod of a towel dispenser, or the screw top of the towel rod. The top layer of the cover provides a surface for the user to place his hand. Preferably this surface is washable or wipable. The bottom layer of the cover is optionally provided with a backing material which can easily adhere temporarily or secure to the paper towel roll when not in use. The circular cover is placed at the top of the paper towel roll to protect the paper towel from user-handling, thereby maintaining required hygiene. The cover can be flexible or rigid and also collapsible and can be made of a variety of materials. Further, the cover can adjust in size, can be in a shape other than circular, and can be structured to have designs thereon based on a user's preference.

BRIEF DESCRIPTION OF DRAWINGS

The features of the present invention are set forth with particularity in the appended claims. Embodiments of the present invention will hereinafter be described in conjunction with the appended drawings provided to illustrate and not to limit the scope of the claims, wherein like designations denote like elements, and in which:

DETAILED DESCRIPTION OF EMBODIMENTS

As used in the specification and claims, the singular forms "a", "an" and "the" include plural references unless the context clearly dictates otherwise. For example, the term "an article" may include a plurality of articles unless the context clearly dictates otherwise. All terms are provided their ordinary meaning unless defined otherwise.

Those with ordinary skill in the art will appreciate that the elements in the Figures are illustrated for simplicity and clarity and are not necessarily drawn to scale.

There may be additional components described in the foregoing application that are not depicted on one of the described drawings. In the event such a component is described, but not depicted in a drawing, the absence of such a drawing should not be considered as an omission of such design from the specification.

The present invention discloses a method for protecting the sheets of a paper towel roll from manual handling by a user. Also disclosed is a protective cover for the paper towel roll. Accordingly, the product and the method steps have been represented, showing only specific details that are pertinent for an understanding of the present invention so as not to obscure the disclosure with details that will be readily apparent to those with ordinary skill in the art having the benefit of the description herein. For example, while "paper towel roll" is employed throughout, it is the intent that a cover as described can be used on any multitude of rolled sheet products such as cloth-type sheets on a roll, or any sheet, which may optionally have perforations, requiring a user's hand to hold the top and another hand to tear a sheet from the roll.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1:
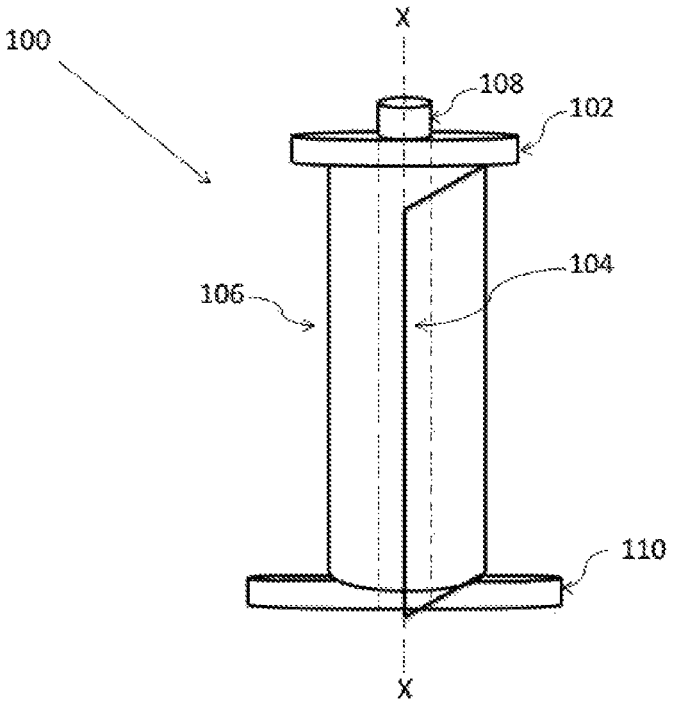
FIG. 1 shows a perspective view of a paper towel roll with paper towel sheets rolled along a vertical axis with respect to the ground and a protective cover.
Figure 5:
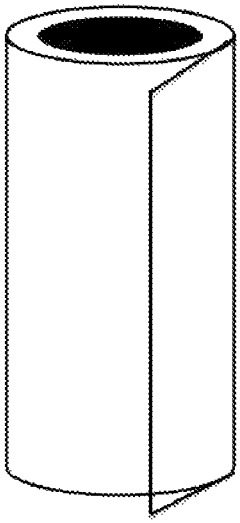
FIG. 5 shows a paper towel roll with a protective cover laying flat on top thereof.

A perspective view of a paper towel dispensing device 100 and a protective cover 102 is shown in FIG. 1 and FIG. 5. The paper towel dispensing device 100 is used to manually dispense a single or plurality of paper towel sheets 104 unwrapping out of a paper towel roll 106. The sheets 104 are wrapped around a towel rod 108 along a substantially vertical axis X-X with respect to ground. The vertical axis X-X can be attached to a firm base 110. As is known in the art, there may be a single paper towel sheet or multiple sheets rolled together.

Figure 2:
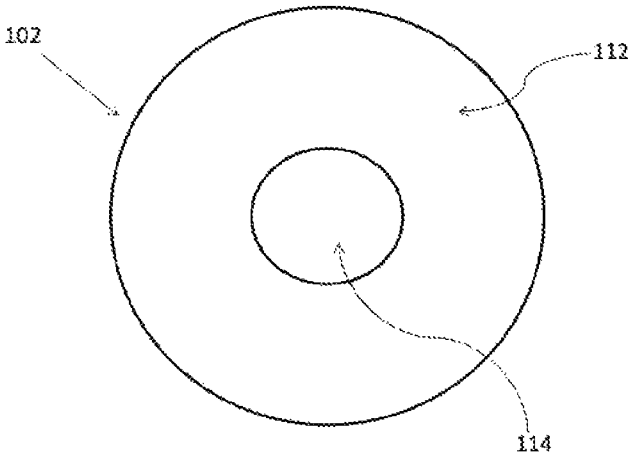
FIG. 2 shows a top view of the protective cover.
Figure 3:
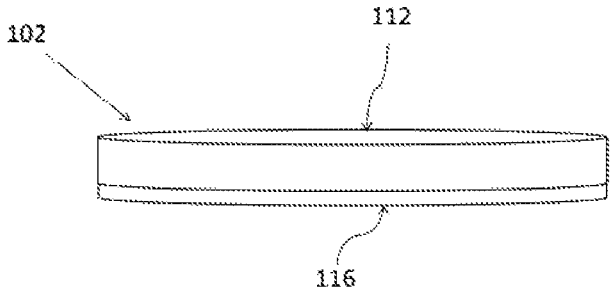
FIG. 3 shows a side view of the protective cover.

The protective cover 102 is placed on the top of the paper towel roll 106 as shown in FIG. 1. The protective cover 102 is also shown in FIG. 2 and FIG. 3. As used herein, protective cover and cover 102 mean the same and are interchangeably used in the current disclosure. It should also be appreciated that the terms towel roll 106, roll 106, and paper towel roll 106 are interchangeably used. The protective cover 102 is used to retain the hygienic condition and the structural integrity of sheets of the paper towel roll 106 when handled by one or multiple users.

According to an embodiment of the present invention, the protective cover 102 is placed on the top of the paper towel roll 106. While using the paper towel roll 106, the user holds down the protective cover 102 with one hand while simultaneously tearing the paper towel sheets 104 off the paper towel roll 106 with the other hand. Thus, the tip or exposed edge of the unused paper towel roll 106 does not make a direct contact with the possible unclean hand of the user. This helps in maintaining the sanitary condition and the structural integrity of the sheets and the paper towel roll 106 for other users. The cover can thereafter be cleaned with regular cleaning and sanitizing products. Alternatively the cover can be disposable and dispensed or traded out for a new cover after a few uses.

Figure 8:
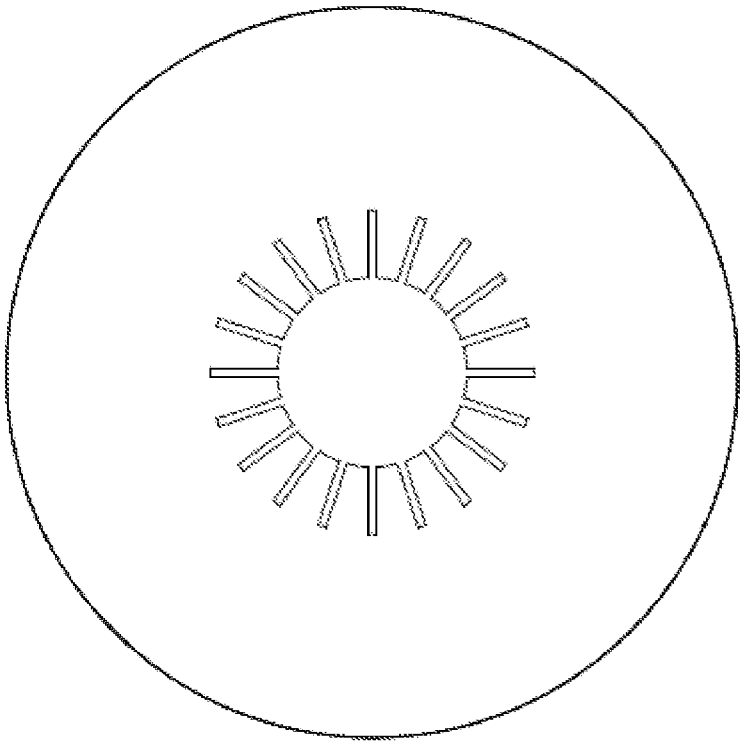
FIG. 8 shows a top view of the protective cover with a hole and slits.
Figure 10:
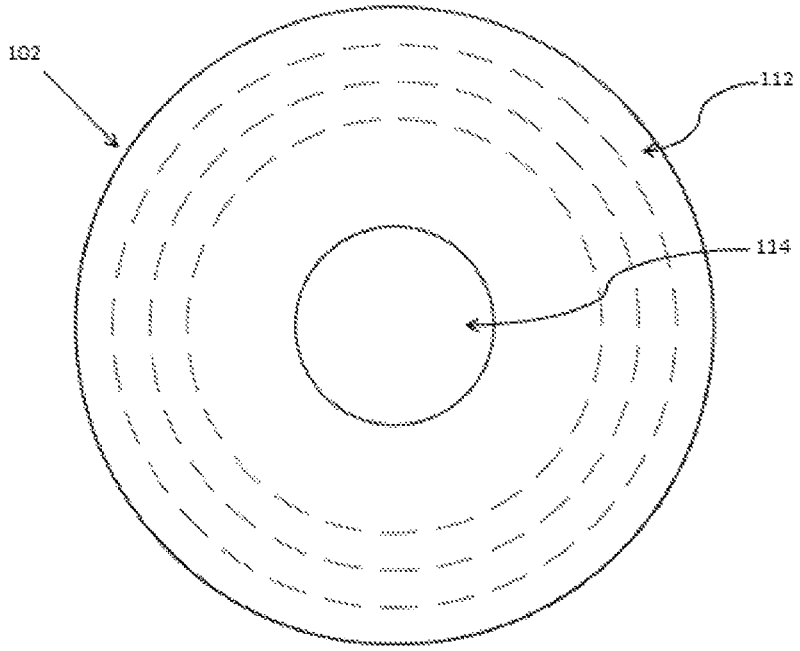

The protective cover 102 includes a top layer 112, a hole 114 at the center of the cover 102 and an optional bottom layer consisting of a backing material 116. The backing material is an option based on user desires, and the cover could be made and used with no backing thereon. The top layer 112 allows the user to place his hand, which maybe soiled or unsanitary on the cover 102 while dispensing the paper towel sheets 104. The hole 114 allows the cover 102 to accommodate a towel rod 108 therein. It should be appreciated that there can also be a slit (FIG. 8) at the center of the cover 102 to accommodate different sizes of towel rods. Initially when the paper towel roll 106 is in an unused condition, i.e., before any paper towel sheets 104 are removed, the cover 102 has the same diameter as that of the paper towel roll 106. As the paper towel roll 106 gets used up its diameter is reduced but the area covered by the protective cover 102 will remain the same at all times. Optionally, the cover 102 maybe cut and resized to match the diameter of the roll 106. Perforations, as seen in FIG. 10, in the cover can allow for ease in resizing of the cover to match the diameter of the roll.

Figure 7:
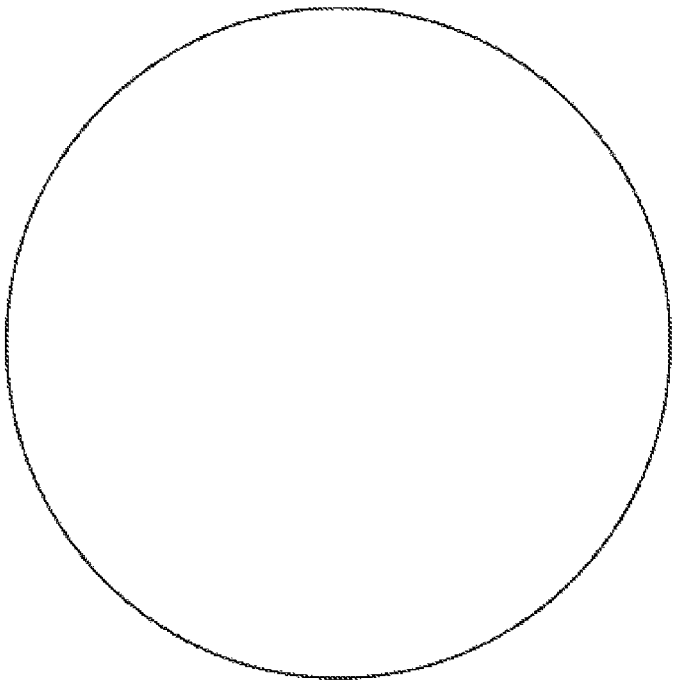
FIG. 7 shows a top view of the protective cover without a hole.

Another embodiment of the cover 102 includes not having a hole so as the cover just fits on top of the towel roll 106 (FIG. 7). In this configuration, it is possible that the towel roll is sitting on a partial rod, or just sitting on a surface without it being secured on a rod or assembly for holding the towel roll altogether.

The lower side of the cover 102 is the side facing the towel roll 106 and can comprise an adhering type of facing. The adhering can be anything which allows the cover to temporarily remain on the primarily cotton or cotton blend towels, but does not permanently adhere to the towels. The backing material 116 can be made of small pieces of Velcro, any type of sticky cloth or felt-type fabric, although not restricting it to one of these. Any type of material that can temporarily adhere to the towel roll 106 while it is held down by the user can be used as the backing material 116 for the cover 102.

The protective cover 102 is made of a light weight material, such as metal, plastic, cloth, rubber-based or thick paper, although not restricting it to one of these. The purpose of using light weight material is to avoid damage to the paper towel roll 106 while held down by the user. It can also be thin pieces of wood cut in a circular pattern. Although it is recognized by skilled artisans that the shape of the cover is irrelevant provided it covers the majority of the diameter of the diameter of the towel roll. The advantages of using one of the above mentioned materials are that they are readily available and clean easily when contaminated. The cover 102 made of paper or cloth has an additional advantage of being disposable with the paper towels. When the paper towel sheets 104 are all used up the user can dispose of the cover 102 with the paper towel roll 106. Alternatively, the user can have a cover which is re-useable and environmentally friendly and can be washed by hand or machine.

The cover can be as thick or thin as the user desires. Preferably to fit standard size United States paper towel rolls, the width of the cover is about 5 inches, the hole diameter is about ½-1 inch, or consists of a hole about ¼ inch with slits, of about ¼-½ inch deep to accommodate various sizes of towel rods. The thickness of the cover can be whatever the user desires but preferably about ⅛ to ¼ inch or less if cloth fabric is employed.

Figure 4:
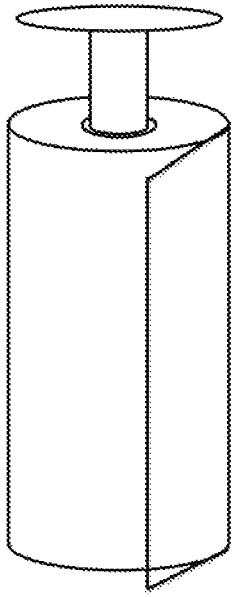
FIG. 4 shows a perspective view of a paper towel roll with a protective cover which is secured onto a rod fitting into the towel roll.
Figure 6:
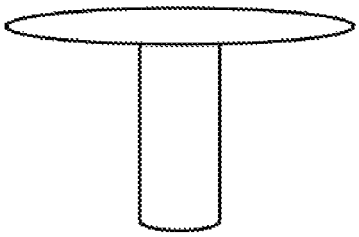
FIG. 6 shows the protective cover secured to a rod or pole.

FIGS. 4 and 6 illustrate a more rigid cover secured on a rod which fits into a towel roll. Shown is a rigid cover but it can also be flexible and or collapsible, provided it is adhered to a rod of some type to slip into a towel roll. The backing here is preferably missing, as it would not be necessary since the cover is secured on a rod. The rod may be any type of rigid or semi-rigid material such as PVC pipe, cardboard, metal or wood dowel, and the like. The cover is preferably of some disposable type material such as cardboard but can be a woven or non-woven type fabric. If the fabric is not sufficiently rigid to hold its shape alone, it can be placed in a rigid or semi-rigid substrate. The combination of rigid or not rigid rod and or cover is chosen by the needs of the user. (FIG. 6)

The towel protector could be sold in bulk for the professional market which could be cut according to size of paper rolls. The edges could be serrated for ease in cutting for desired use, or to fit consumer needs. The cover could have perforations to adjust the size of the cover (FIG. 10). Other morphologies are envisioned. For example, a nested package could be prepared of varying sizes and shapes to fit the paper roll being protected. It could also be sold individually.

Figure 9:
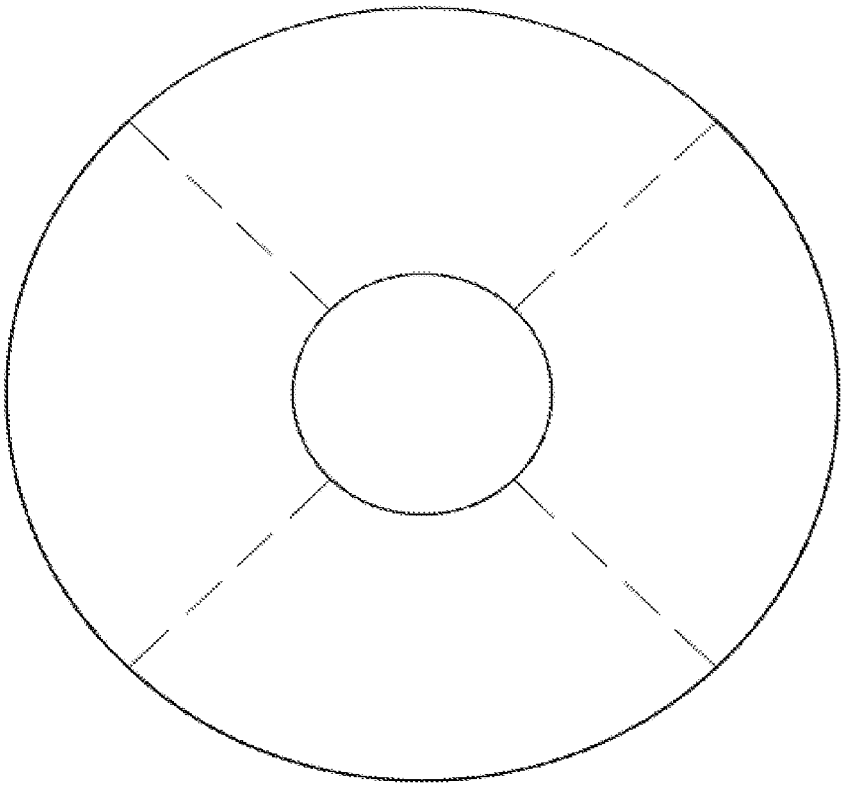
FIG. 9 shows fold lines along the protective cover to allow for collapsibility of the cover; and, FIG. 10 shows perforations along the edging of the protective cover to allow for adjustment or ease of cutting of the size of the cover to the towel roll.

The protector could be sold on a rod as discussed herein and per FIG. 6. The diameter of the protector could be varying sizes to fit the towel package. It could collapse for ease in packaging and transport in bulk. As a collapsible implement, an embodiment shown in FIG. 9, it could be packaged together with the paper towel package for the convenience of the consumer. If collapsible, the rod cover would be somewhat flexible possibly semi rigid. Overall, the towel protector implement cover alone or in combination with the rod can be sold separately. It can be as a package with or without the paper towels. It can also be combined with several paper related implements. In the latter case, the cover protector can be all the same size and with or without a backing. The cover can also be placed in a sealed package.

The present invention has been described herein with reference to a particular embodiment for a particular application. Although selected embodiments have been illustrated and described in detail, it may be understood that various substitutions and alterations are possible. Those having ordinary skill in the art and access to the present teachings may recognize additional various substitutions and alterations are also possible without departing from the spirit and scope of the present invention, and as defined by the following claims.

What is claimed is:

1. A towel roll comprising a plurality of towel sheets provided with a protective cover, the protective cover consisting of a planar disc having a disc diameter, a top flat surface and a bottom flat surface and a thickness of less than ¼ of an inch, wherein the protective cover is disposed on an end of the towel roll such that a sidewall of the roll is exposed for dispensing and the top flat surface of the protective cover is positioned, configured and dimensioned for holding the cover by a user with a first hand while tearing at least one towel sheet of the plurality of towel sheets with a second hand, and wherein the protective cover has perforations so as to be adjustable to the size of the towel roll.

2. The towel roll according to claim 1, wherein the protective cover further comprises a central through-hole.

3. The towel according to claim 1, wherein the protective cover further comprises a central post to engage the central core opening of the paper towel roll.

4. The towel according to claim 1, wherein the plurality of towel sheets are made from at least one of a cloth and a paper.

5. The towel according to claim 1, wherein the top flat surface of the protective cover is washable.

6. The towel according to claim 1, the protective cover further comprising a bottom layer attached to the bottom flat surface of the protective cover, wherein the bottom layer adheres sufficiently to the towel roll so as the protective cover will not move when the plurality of the towel sheets is not held by a user and the protective cover is placed on top of the towel roll.

7. A method of dispensing paper towel sheets from a vertically standing roll of paper towel comprising:

providing the towel roll and protective cover of claim 1, and holding the protective cover with a first hand while tearing at least one towel sheet of the plurality of towel sheets with a second hand.

8. A protective cover device for securing a paper towel roll while at least one sheet is removed, wherein the protective cover device comprises a planar disc having a top flat surface and a bottom flat surface, with a thickness of less than ¼ of an inch, and wherein the protective cover device is disposed on one flat end of a paper towel roll and is configured and positioned to be held by the user while removing the sheet, and wherein the planar disc has annular perforations.

9. The protective cover device of claim 8, wherein the planar disc has a central through-hole configured to accept a central post or screw top of a paper towel roll holder.

10. The protective cover device of claim 8, wherein the planar disc has a central post extending from the bottom flat surface configured to engage the core of the paper towel roll.

11. The protective cover device of claim 10, wherein the planar disc comprises a flexible or collapsible material.

12. The protective cover device of claim 8, wherein the planar disc has an adhesive material on the bottom flat surface.

13. The protective cover device of claim 8, wherein the planar disc comprises a disposable material.

14. The protective cover device of claim 8, wherein the planar disc comprises a material suitable to be machine washed.

15. A method of dispensing paper towel sheets comprising using the protective cover device of claim 8, wherein a user holds the protective cover device with a first hand while tearing at least one towel sheet from the paper towel roll with a second hand.

* * * * *